US007323221B2

(12) United States Patent
Heppekausen et al.

(10) Patent No.: US 7,323,221 B2
(45) Date of Patent: Jan. 29, 2008

(54) COATING OF OBJECTS

(75) Inventors: Josef Heppekausen, Wesseling (DE); Frank Schulte, Cologne (DE)

(73) Assignee: Leybold Vakuum GmbH, Cologne (DE)

( * ) Notice: Subject to any disclaimer, the term of this patent is extended or adjusted under 35 U.S.C. 154(b) by 116 days.

(21) Appl. No.: 10/499,558

(22) PCT Filed: Dec. 17, 2002

(86) PCT No.: PCT/EP02/14375

§ 371 (c)(1),
(2), (4) Date: Dec. 20, 2004

(87) PCT Pub. No.: WO03/056187

PCT Pub. Date: Jul. 10, 2003

(65) Prior Publication Data

US 2005/0098441 A1 May 12, 2005

(30) Foreign Application Priority Data

Dec. 22, 2001 (DE) ..... 101 63 864

(51) Int. Cl.

| | |
|---|---|
| ***B05D 3/00*** | (2006.01) |
| ***B05D 7/22*** | (2006.01) |
| ***C23C 28/00*** | (2006.01) |
| ***C25D 11/18*** | (2006.01) |
| ***C25D 11/04*** | (2006.01) |

(52) U.S. Cl. ..... 427/294; 427/238; 427/331; 427/372.2; 205/188; 205/189; 205/190; 205/198; 205/200; 205/201; 205/204; 205/322; 205/324; 205/325; 205/333

(58) Field of Classification Search ..... 205/188, 205/189, 190, 198, 200, 201, 204, 322, 324, 205/325, 333; 428/472, 472.2, 308.4; 123/200; 427/294, 238, 331, 372.2
See application file for complete search history.

(56) References Cited

U.S. PATENT DOCUMENTS

| | | | | |
|---|---|---|---|---|
| 5,158,663 | A * | 10/1992 | Yahalom | 205/50 |
| 5,487,825 | A * | 1/1996 | Kurze et al. | 205/200 |

FOREIGN PATENT DOCUMENTS

| | | | |
|---|---|---|---|
| DE | 1 621 936 | | 8/1971 |
| DE | 4124730 | A1 * | 1/1993 |
| DE | 41 24 730 | C2 | 9/1996 |
| DE | 42 39 391 | C2 | 11/1996 |
| EP | 0 545 230 | A1 | 6/1993 |
| JP | 08-281868 | | 10/1996 |
| JP | 08284605 | A * | 10/1996 |
| JP | 2001271704 | A * | 10/2001 |

OTHER PUBLICATIONS

Zhits et al., "Nonstick Protective Coatings for Steam-Turbine Condenser Tubes", Tyazheloe Mashinostroenie (no month, 1993), vol. 10, pp. 19-24, Abstract Only.*
International Search Report for PCT/EP02/14375; ISA/EPO/210; Mailed: Apr. 29, 2003.

* cited by examiner

*Primary Examiner*—Edna Wong
(74) *Attorney, Agent, or Firm*—Harness, Dickey & Pierce, PLC

(57) ABSTRACT

The present invention relates to a process for the coating of objects made of valve metals or their alloys with a thin barrier layer consisting of the metal and an oxide ceramic layer provided thereon whose surface has been coated with fluoropolymers, characterized in that the fluoropolymers are introduced into the capillary system of the oxide ceramic layer in the form of a solution by vacuum impregnation, followed by removing the non-wetting portions of the solution and drying.

7 Claims, No Drawings

COATING OF OBJECTS

The present invention relates to a process for the coating of objects made of valve metals or their alloys, and to the objects thus obtained.

EP 0 545 230 A1 relates to a method for producing optionally modified oxide ceramic layers on barrier-layer metals and products obtained. To increase the thickness and wear resistance of oxide ceramic layers on barrier-layer metals, a plasma-chemical anodic oxidation is performed in a chloride-free electrolyte bath having a pH value of from 2 to 8 at a constant current density of at least 1 A/dm$^2$ until the voltage reaches a final value. On objects of aluminum or aluminum alloys, an oxide ceramic layer consisting of corundum can be produced. Also on magnesium and titanium, layer thicknesses of up to 150 μm are achieved.

For many applications, highly loaded component parts of valve metals must be corrosion-resistant and wear-resistant even under extreme conditions. This is achieved by providing such objects with an oxide ceramic layer having a wide-meshed interlinked capillary system, introducing particles of fluoropolymers which at least in one dimension are smaller than the diameter of the capillaries, and exposing the object with the prefilled capillary system to changing pressure conditions.

DE 41 24 730 C2 relates to a method for incorporating fluoropolymers into microporous surfaces of objects made of aluminum or its alloys prepared by anodic oxidation, characterized in that an aqueous suspension of fluoropolymers or their precursors having a particle size of from 1 to 50 nm is incorporated into the capillaries of a hard anodized aluminum layer which are perpendicular to the metal.

DE 42 39 391 C2 relates to objects of aluminum, magnesium or titanium having an oxide ceramic layer filled with fluoropolymers, and to methods for preparing them. Described are objects made of the barrier-layer metal having a thin firmly adhering barrier layer on the metal superposed by a sintered dense oxide ceramic layer and, on top of this, an oxide ceramic layer with a wide-meshed interlinked capillary system which is essentially filled with fluoropolymers. In particular, the oxide ceramic layer has a thickness of from 40 to 150 μm. Examples of such objects are rotors for turbo-molecular pumps, turbochargers for diesel or gasoline engines, component parts from vacuum or plasma technology, rollers for coronary discharges, and ultrasonic sonotrodes, each of aluminum or aluminum alloys. It is described that particles of the fluoropolymers or its precursor which are to be introduced into the outer oxide ceramic layer, unless being liquids, are introduced as a solution or suspension in a suitable solvent. The essential core of this description is subjecting the particles of fluoropolymers in a suitable solvent to changing pressure conditions, for which an impregnating system is suitable in which the air is first removed from the capillary system of the oxide ceramic layer using a vacuum, and subsequently, under the action of the vacuum, the particles enter the pores and, after the vacuum has been released, are pressed into pores by the atmospheric pressure and thus are supposed to reach fine ramifications as well.

As particularly suitable fluoropolymers, there are described, in particular, the polymers and copolymers of tetrafluoroethylene, hexafluoropropene, vinylidene fluoride, vinyl fluoride and trifluorochloroethylene. These fluoropolymers are known to be soluble in virtually no solvent, so that it is to be considered that these fluoropolymers are introduced into the surface in the form of dispersions according to DE 42 39 391 C2.

A similar process is described in Japanese Patent JP 2,913,537. A corrosion-resistant construction is characterized in that a plated layer of an Ni—P alloy having a thickness of about 20 μm is provided in an aluminum/alloy part of a turbo-molecular pump for releasing chlorine gas in semiconductor production devices, which part comes into contact with chlorine gas, and that a fluororesin protective layer is formed on said plated layer by immersing a rotor and a stator of said turbo-molecular pump into a liquid for forming the layer of fluororesin, followed by drying.

The above mentioned prior art documents have the common feature that the fluoropolymers are essentially provided on the outer surface of the oxide-ceramic layer, but enter the ramifications only to a low extent.

Thus, it is the object of the present invention to improve the uniformity of the coating and thus the sealing property of objects, especially oxide-ceramic layers.

In a first embodiment, the above object is achieved by a process for the coating of objects made of valve metals or their alloys with a thin barrier layer consisting of the metal and an oxide ceramic layer provided thereon whose surface has been coated with fluoropolymers, characterized in that the fluoropolymers are introduced into the capillary system of the oxide ceramic layer in the form of a solution by vacuum impregnation, followed by removing the non-wetting portions of the solution and drying.

By the aftertreatment of oxide or ceramic layers, especially anodically produced ones, by vacuum impregnation with solutions of fluoropolymers, the properties with respect to the tightness of the protective layers can be substantially improved over the prior art. Another advantage in the application of the polymers described resides in their extremely high resistances towards aggressive and corrosive media. These media may be gaseous, for example, in the use of turbo-molecular pumps in plasma etchers, but may also comprise liquids or vapors of acids or alkalis.

Similarly, the impregnation with fluoropolymers in a dissolved form is also possible without the necessity of a previous applied coating of an oxidic or ceramic kind. The thus treated surfaces are also characterized by particular properties, such as the repelling of soil or dust particles, and non-wettability by media such as water, oils or other liquids.

Using the present invention, it is possible to significantly improve the uniformity of the coating over the prior art. This purpose is served by the vacuum impregnation of the above mentioned layers in which the dissolved fluoropolymer enters the pores or microscopically small cavities in the layers.

The advantages of the coatings according to the invention are due, in particular, to the very low surface energy. It results in an optimum barrier effect towards almost all solvents, which include, in particular, solvents, oils, (also silicone oils) and water-based liquids. Solids can also deposit on the surface of the film only with difficulty. In addition, the same property causes a very good adhesion to the valve metals. Further to be pointed out is a high chemical, thermal and electrical stability which remains unaffected by the usual operation conditions to which the treated surfaces are exposed.

It is particularly preferred within the meaning of the present invention to employ aluminum, magnesium, titanium, niobium or zirconium and their alloys as the valve metal.

To be pointed out here particularly are aluminum and aluminum alloys, which are frequently employed for preparing rotors in turbo-molecular pumps.

The term "aluminum and its alloys" as used in the present invention means superpure aluminum and the alloys AlMn, AlMnCu, $AlMg_1$, $AlMg_{1.5}$, E-AlMgSi, $AlMgSi_{0.5}$, $AlZnMgCu_{0.5}$, $AlZnMgCu_{1.5}$, G-$AlSi_{12}$, G-$AlSi_5Mg$, G-$AlSi_8Cu_3$, G-$AlCu_4Ti$, G-$AlCu_4TiMg$.

Further suitable for the purposes of the invention are, in addition to pure magnesium, especially the magnesium cast alloys with the ASTM designations of AS41, AM60, AZ61, AZ63, AZ81, AZ91, AZ92, HK31, QE22, ZE41, ZH62, ZK51, ZK61, EZ33, HZ32, and the kneaded alloys AZ31, AZ61, AZ80, M1 ZK60, ZK40.

Further, pure titanium or else titanium alloys, such as $TiAl_6V_4$, $TiAl_5Fe_{2.5}$ and others, may also be employed.

It is particularly preferred according to the present invention for the oxide ceramic layer to be prepared from a more or less graded material in which the oxide ceramic layer is densely sintered on the side of the barrier layer and has a wide-meshed interlinked capillary system on the opposite side. Corresponding oxide ceramic layers are known, for example, from DE 42 39 391 C2.

Also according to the present invention, oxide ceramic layers are employed having a thickness of from 40 to 150 μm, especially from 50 to 120 μm, as also known from DE 42 39 391 C2.

The fluoropolymers which may be employed according to the present invention are preferably selected from fluorinated epoxide polymers, silyl ethers, especially fluoroaliphatic silyl ethers, polyacrylates and/or urethanes.

Under the designation of Fluorad™, a number of different fluoropolymers are sold by the 3M Company. Fluorad™ FC-405/60 is described as a concentrated solution of a fluoroaliphatic silyl ether which can be diluted with alcohol, ketones, acetate and may also be dissolved in water. Fluorad™ FC-722 is described as a fluorinated acryl polymer in an inert fluorinated solvent. Being a thermoplastic, the agent will not dry out so that higher temperatures and exothermic reactions by ultraviolet or low-temperature systems become superfluous. Fluorad™ FC-725 is described as a fluorinated acrylate polymer in butyl acetate. It is a one-component dissolved polymer with unlimited keeping quality.

It is particularly preferred according to the present invention to apply the fluoro-polymers in a layer thickness of from 1 to 20 μm, especially from 1 to 5 μm. For the polyacrylates, a particularly low layer thickness is a particular advantage. For example, it is possible to apply these also in a layer thickness of from 1 to 2 μm.

Various methods can be employed for impregnating the objects. The respectively selected method depends on the fluoropolymers to be used and the demands on the objects.

The dry vacuum/pressure impregnation method is the slowest and most complicated vacuum impregnation method. The process of vacuum impregnation described in the following requires two tanks, one storage tank for the solution of the fluoropolymer and one in which the objects/workpieces are impregnated:

- drawing a vacuum within the impregnation vessel to remove the air from the pores of the objects;
- transferring the solution of the fluoropolymer from the storage tank into the impregnation vessel until the workpieces, which are still under vacuum, are submerged;
- aerating the impregnation vessel, followed by pressurizing with compressed air;
- retransferring the solution of the fluoropolymer into the storage vessel by means of the increased pressure, followed by deaeration to normal pressure;
- removing and rinsing the objects;
- performing further process steps.

The dry vacuum method is preferably employed for highly viscous solutions of fluoropolymers. Also according to the present invention, it is particularly preferred to employ this method when the pores are very small, and the demands on the coated objects are extraordinarily high.

In the wet vacuum/pressure method, only one tank is required. The objects are immersed in the solution of the fluoropolymer which constantly remains in the impregnation vessel. The objects and the solution of the fluoropolymer are commonly placed under vacuum and subsequently pressurized with compressed air:

- drawing a vacuum within the impregnation vessel to remove the air from the pores of the parts;
- aerating to normal pressure, followed by pressurizing the tank with compressed air;
- deaerating to normal pressure; removing and rinsing the workpieces;
- performing further process steps.

The wet vacuum/pressure method is recommended, for example, for impregnating objects having very small pores and for sinter metal parts of high density.

The wet vacuum method is the simplest and quickest vacuum impregnation method. It may be compared to the wet vacuum/pressure method; however, the tank is not pressurized. Instead, the impregnation vessel is merely aerated after the vacuum. The sealing material impregnates the parts at atmospheric pressure. The solution of the fluoropolymer flows into the vacuum formed in the pores of the parts and displaces it:

- drawing a vacuum to remove the air from the pores;
- aerating to normal pressure;
- briefly allowing the parts to dwell in the impregnation vessel in order that the solution of the fluoropolymer impregnates them;
- removing and rinsing the workpieces;
- performing further process steps.

The wet vacuum impregnation is by far the preferred method. Its simplicity and fastness and the advantage of low installation costs make it the preferred method if the impregnation system is newly installed.

Following vacuum impregnation, the non-wetting portions of the solution are removed, and the solvent is optionally removed at elevated temperature. For example, a fluoroaliphatic coating such as of Fluorad™ FC-405/60 can be dried within a short period of from 5 to 10 min at 110° C. or in the course of 24 hours at room temperature.

To increase the layer thickness, it is also possible, of course, to repeat the steps of introducing and drying the fluoropolymers several times.

In a further embodiment, the invention comprises objects made of valve metals which can be obtained by the above mentioned method. It is particularly preferred according to the present invention for these objects to be rotors for turbo-molecular pumps, which are mostly prepared from aluminum or aluminum alloys.

By means of the present invention, objects become obtainable which are characterized by an extremely low admittance of the surface, which could be shown by comparative measurements of the admittance of untreated oxide layers and vacuum-impregnated oxide layers.

In vacuum impregnation, the complete filling of the pores in the oxidic layer and thus of the entire surface is ensured.

With the pore dimensions of layers produced by plasma chemistry, especially with hard anodic oxide layers, this approach is particularly advantageous.

The classical immersion treatment only reaches the wettable surface, but does not enter the pores (particularly the pores of hard anodic layers).

In this connection, tests were performed on plasma-oxidic layers and showed a difference:

An admittance of 42 μS was established for an immersion treatment with thermal aftertreatment at 110±10° C. over a period of 30 min as compared to 7 μS for a vacuum impregnation according to the invention.

EXAMPLES

Example 1

Comparative Example 1

A sample sheet of the aluminum alloy $AlMgSi_1$ was anodically oxidized in a normal standard electrolyte, and an average layer thickness of 25 μm was established. The sample sheet was dried, and an admittance of 140 μS was determined (Comparative Example 1).

Thereafter, the sample sheet was vacuum-impregnated in a solution of the commercially available fluorinated acrylate Fluorad™ FC-732 at a pressure of <0.1 mbar and subsequently treated at a temperature of ±10° C. in the course of 30 min, and the admittance was also established. After vacuum impregnation, an admittance of 10 μS was found (Example 1).

For a comparative determination of the admittance, a measuring cell with a contact area having a diameter of 2.3 mm was used. A potassium sulfate solution served as an auxiliary electrolyte. For the measurement itself, an "Anotest YD" of the Fischer company was employed.

Example 2

Comparative Example 2

A sample sheet of the aluminum alloy according to Example 1/Comparative Example 1 was coated with a 20 μm thick plasma-oxidic layer. The sample was also dried, and an average admittance of 35 μS was determined (Comparative Example 2).

Thereafter, the sample was vacuum-impregnated and thermally treated as described in Example 1. Subsequently, an admittance of <3 μS was established (Example 2).

The invention claimed is:

1. A process for the coating of objects made of valve metals selected from aluminum, magnesium, titanium, niobium and/or zirconium and their alloys with a thin barrier layer consisting of said metals and an oxide ceramic layer provided thereon whose surface has been coated with a solution containing dissolved fluoropolymers characterized in that the solution is introduced into a capillary system of the oxide ceramic layer by vacuum impregnation, followed by removing non-wetting portions of the solution and drying.

2. The process according to claim 1, where said oxide ceramic layer comprises a densely sintered oxide ceramic layer disposed on the thin barrier layer and an oxide ceramic layer having a wide-meshed interlinked capillary system applied by plasma-chemical anodic oxidation to said densely sintered oxide ceramic layer.

3. The process according to claim 1, wherein said oxide ceramic layer has a thickness of from 40 to 150 μm.

4. The process according to claim 1, wherein the dissolved fluoropolymers of the solution are selected from fluorinated epoxide polymers and silyl ethers.

5. The process according to claim 1, wherein said coating has a layer thickness of from 1 to 20 μm after the drying.

6. The process according to claim 5, wherein the layer thickness is from 1 to 5 μm after the drying.

7. The process according to claim 1, wherein the steps of introducing and drying the dissolved fluoropolymers are repeated several times.

* * * * *